US007161546B2

(12) United States Patent
Gelman et al.

(10) Patent No.: US 7,161,546 B2
(45) Date of Patent: Jan. 9, 2007

(54) CLIP LIKE CONTACT ELEMENT

(75) Inventors: Alexander Gelman, Fellbach (DE); Ortwin Zoller, Altdorf (DE); David Silva, Nürtingen (DE)

(73) Assignee: Hirschmann Electronics GmbH & Co. KG, Neckartenzlingen (DE)

( * ) Notice: Subject to any disclaimer, the term of this patent is extended or adjusted under 35 U.S.C. 154(b) by 19 days.

(21) Appl. No.: 10/916,765

(22) Filed: Aug. 11, 2004

(65) Prior Publication Data

US 2005/0090160 A1 Apr. 28, 2005

(30) Foreign Application Priority Data

Aug. 11, 2003 (DE) ..... 103 36 844
Jan. 17, 2004 (DE) ..... 10 2004 002 512

(51) Int. Cl.
*H01Q 1/32* (2006.01)

(52) U.S. Cl. ..... 343/713; 343/711

(58) Field of Classification Search ..... 343/711, 343/713, 704, 906
See application file for complete search history.

(56) References Cited

U.S. PATENT DOCUMENTS 5,675,347 A * 10/1997 Terashima et al. ..... 343/713
6,025,806 A * 2/2000 Deininger et al. ..... 343/713
6,097,345 A * 8/2000 Walton ..... 343/769
6,825,812 B1 * 11/2004 Yokota et al. ..... 343/713
2004/0263403 A1 * 12/2004 Zafar et al. ..... 343/713

* cited by examiner

*Primary Examiner*—Tho Phan
(74) *Attorney, Agent, or Firm*—Andrew Wilford

(57) ABSTRACT

A cliplike contact element which can be used to provide an electrical contact between an antenna amplifier mounted on a body of an automotive vehicle and an antenna structure on a window of the vehicle has two interfitting contact partners with the outer contact partner having at least an electrically-conductive surface hugging the conductive surface of the inner contact partner. The contact partners can be bonded, e.g. by soldering to respective conductors.

8 Claims, 6 Drawing Sheets

CLIP LIKE CONTACT ELEMENT

CROSS REFERENCE TO RELATED APPLICATIONS

This application is related under 35 U.S.C. 119 to the German applications 103 36 844.2 filed 11 Aug. 2003 and 102 004 002512.6 under the International Convention

FIELD OF THE INVENTION

The invention relates to a device for contacting, i.e. making electrical contact between, a first contact partner with at least one further contact partner.

BACKGROUND OF THE INVENTION

DE 196 05 999 A1 describes the contacting of a flat antenna structure. In this system, a signal processing unit, especially an antenna amplifier, is located below a part of the body of the automotive vehicle. The housing of this unit has a support or outrigger arm provided at the end with contacting means. This contacting means is connected via connecting conductors with the signal processing unit, the conductors being located in or on the rigid support. Through the contacting means electrical contact is made with the contact surfaces of an antenna conductor structure which is provided on a vehicle window. The carrier enables the connection between the signal processing unit and the antenna conductor structure over a certain distance. Because of the variations in the places at which the unit may have to be mounted and the locations of the contacting surfaces of the antenna conductor structure, there are significant tolerance ranges which are encountered by the contacting means engageable with the contact surfaces of the antenna conductor structure. Another drawback of this construction is that the entire signal processing unit with the carrier and the contact means disposed on the carrier must be completely replaced when, for example, these parts are damaged in a crash of the automotive vehicle. This is associated with a high cost since the signal processing unit is as a rule integrated between the body (vehicle roof) and the ceiling of the vehicle and thus is only accessible with difficulty.

It is also a drawback that with rigid carriers, the components can only be matched to a particular vehicle type since each vehicle type has available only a certain location or space for the unit. Matching the units to the vehicle is thus connected with high cost since for each vehicle type different tools are required to produce the carrier.

OBJECT OF THE INVENTION

The invention has as its object to provide a device for contacting a first contact partner with at least one second contact partner whereby the drawbacks described at the outset are avoided and whereby via the contacting, a positional fixing and attachment is also effected.

SUMMARY OF THE INVENTION

According to the invention this object is achieved in that the surface of the one contact partner encloses at least partially and especially fully in a formfitting and releasable manner the surface of the further contact partner, whereby in an especially advantageous configuration, the contact partners interfit in a cup shape in one another. In this fashion, it is possible on the one hand to provide a simple and inexpensive mass product contact partner since it can be made from low cost sheet metal or another material which is at least conductive on its surfaces, especially by a shaping or stamping process. In addition, the invention has the advantage that it allows a material for the contact partners to be selected which can be provided in a simple way with contact surfaces making electrical contact with one another.

The contact at the contact surfaces of the partners can be effected by soldering processes although other connection techniques for making electrical connections to the contact partners are not excluded.

Thus in the fabrication and shaping of the contact partner to a cup shape, a connection of the thus shaped contact partner by soldering with a conductor track of a printed circuit board or other comparable contact surface is possible.

The cup shape of the two contact parts has a number of advantages in addition. For example, since the diameter of one contact part at a certain location or in a certain region is greater than the diameter of the other contact part at the particular location or particular region, the two contact parts can be so pressed together that there is a tearing of any corrosive layer on the mutually engaging contact surfaces of the contact parts to improve the electrical contact therebetween. In such a case, surface coatings which would otherwise be necessary to prevent corrosion of the surfaces can be omitted. Alternatively, it is also conceivable to provide the contact parts with surface coatings to limit corrosion. It is also advantageous to provide the cup shaped surfaces which are to engage in one another, upon assembly, such that rough environmental conditions having their origins especially in temperature fluctuations, vibrations and the like, do not interfere with effective electrical contact and such that such contact is maintained in spite of these conditions. In this respect, it is advantageous to enable the two contact parts to be separable from one another relatively easily as is required when there is a defect in the unit.

A further advantage is that by correspondingly shaping the contact partners, not only can an electrical contact be made but the partners can be fastened together. This is especially advantageous when the contacts, for example in the case of an antenna amplifier or similar device in a vehicle, which can have a circuit board, are to enable one contact partners on the circuit board to be fastened to the second contact partners on a contact surface of an antenna structure. The shapes and positions of the contact partners on the circuit board correspond with those of the contact partners on the antenna structure so that with a simple pressing of the circuit board, which can optionally be protected in a housing, the antenna amplifier can be mounted on the vehicle window or other planar surfaces of the vehicle, i.e. fastened thereon. In this manner, simple mounting and dismounting is possible. Through the cup shape of the two corresponding contact parts there is simultaneously an electrical contact and mechanical positional attachment in an especially advantageous manner.

BRIEF DESCRIPTION OF THE DRAWING

Embodiments of the device of the invention for making electrical contact in accordance with the invention have been illustrated in a nonlimiting manner and described below with reference to the accompanying drawing, in which.

SPECIFIC DESCRIPTION

Figure 1:
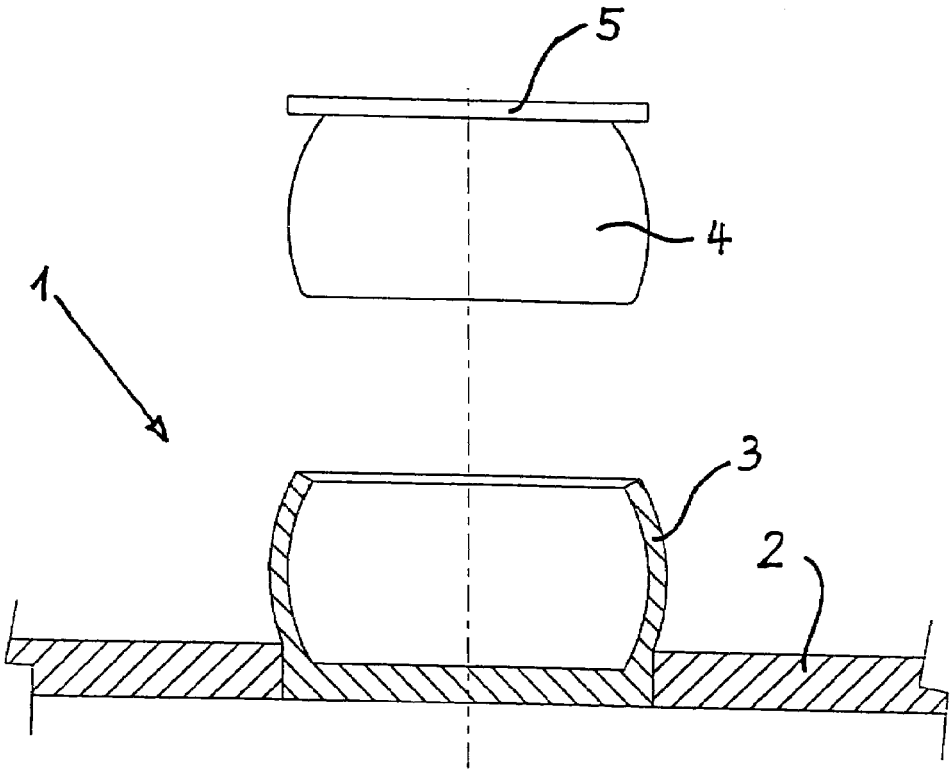
FIG. 1 is an exploded sectional view of two contact partners before making electrical contact.

FIG. 1 shows a first embodiment of a device 1 for making electrical contact and which, for example, has a printed circuit board of an electronic device. This circuit board 2 is, for example, a carrier of electrical and electronic components which form an antenna amplifier or the like for an automotive vehicle. Such an antenna amplifier is in itself known and must make an electrical contact with at least one part of an antenna structure which can be found on a planar surface of the automotive vehicle (for example on the rear window pane).

For this purpose, the circuit board 2 has a first contact part 3 which in FIG. 1 is shown to have a cup shape. Corresponding thereto is a second contact part 4 which corresponds with the cup shape of the first contact part 3. This second contact part 4 has an especially planar contact surface 5 whereby in a manner conforming to the invention, the contact surface 5 of the second contact part 4 is nondetachably connected with the surface of the antenna structure (not shown). That means that the second contact part 4, for example, by means of a soldering process is connected through the contact surface 5 with the contact surface of the antenna structure. A window pane or other planar surface of the vehicle, having this kind of contact part 4 applied thereto and provided with the antenna structure can have the first contact part 3 simply set onto it and pressed together with the further contact part to make electrical contact therewith and fix the first contact part 3 in its position.

Figure 2:
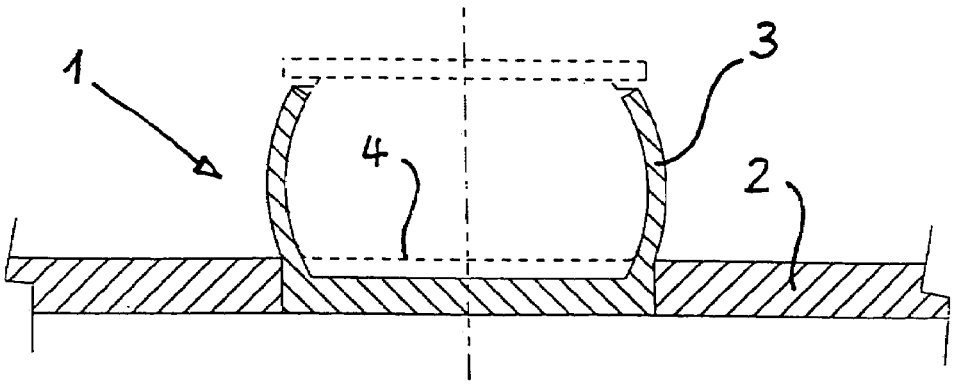
FIG. 2 is a cross section showing the two contact partners of FIG. 1 after making electrical contact.

The contacting and positional fixing after the pressing together of the two contact parts 3 and 4 has been illustrated in FIG. 2. In this case, it is also recognizable that in an especially advantageous way, the cross section of the first contact part 3 tapers upwardly to enclose the second contact part 4 and, in addition to providing the electrical contact for the circuit board 2 through the two contact parts 3 and 4, fixes the circuit board 2 in position. By means of the cup shape, it is also possible to compensate for fabrication tolerances, especially when contacting requires a plurality of mutually interfitting corresponding contact parts 3 and 4.

Figure 3:
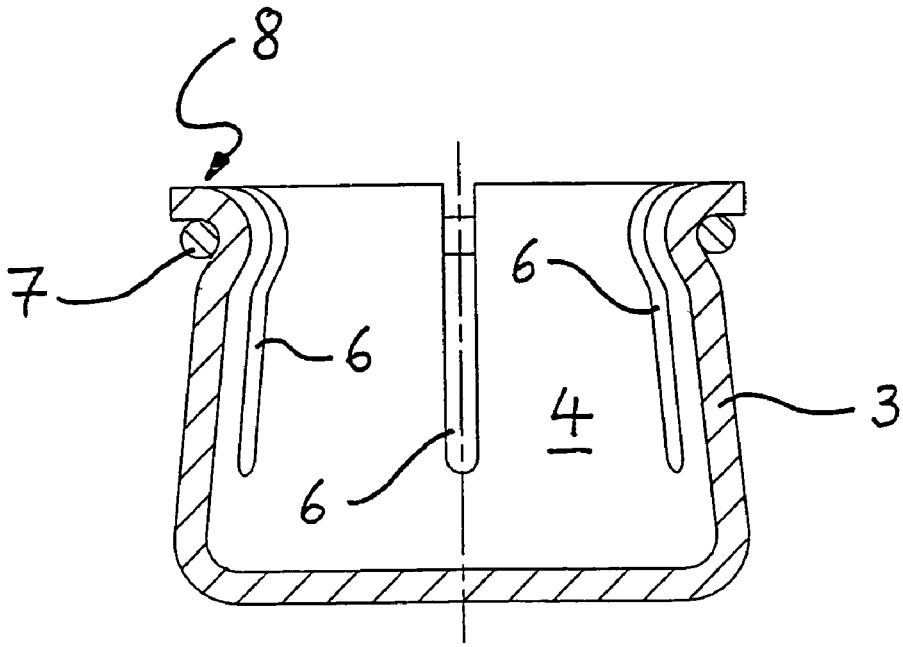
FIG. 3 is an axial cross section of a second embodiment of a contacting device.

In FIG. 3, a second embodiment of the device according to the invention has been illustrated. (The second contact part 4 is not shown). It is also apparent here that the first contact part 3 forming one of the contact partners is capable of at least partly and preferably completely, formfittingly and releasably surrounding the surface of the further contact partner or its second contact part 4 whereby at least one of the two contact parts 3, 4, in this embodiment the outwardly lying contact partner 3, has at least one slit 6 and especially a plurality of slits 6. By means of the slits 6, the respective contact partner is elastically deformable during the contact forming operating so that the surfaces of both contact partners can lie against one another in the contacting state, whereby during the contact pressing (mounting of the one contact part 3 on the further contact part 4 or vice versa), a certain pressure will be generated insuring that the two contact parts will continue in engagement with one another.

To increase the force with which the two contact parts 3, 4 bear upon one another, a pressure element 7 is provided, whereby this pressure element 7 in an particularly advantageous manner can extend radially around the outer contact part and generate an inwardly directed force in the direction of the inwardly lying contact part 4. Conversely, such a pressure element can also be disposed within the contact part 4, whereby a force at least partly over the periphery of this part and especially over the entire periphery thereof can be applied radially outwardly in the direction of the contact part 3. In order to insure a fixed position of the pressure element 7 on at least one of the contact parts (here the contact part 3), the contact part has especially in its upper region, a collar shape in which the pressure element 7 is received. This collar shape 8 which also extends over the full periphery and is open radially can be produced simply on the contact part 3 by bending it outwardly, recessing it inwardly or the like.

Figure 4:
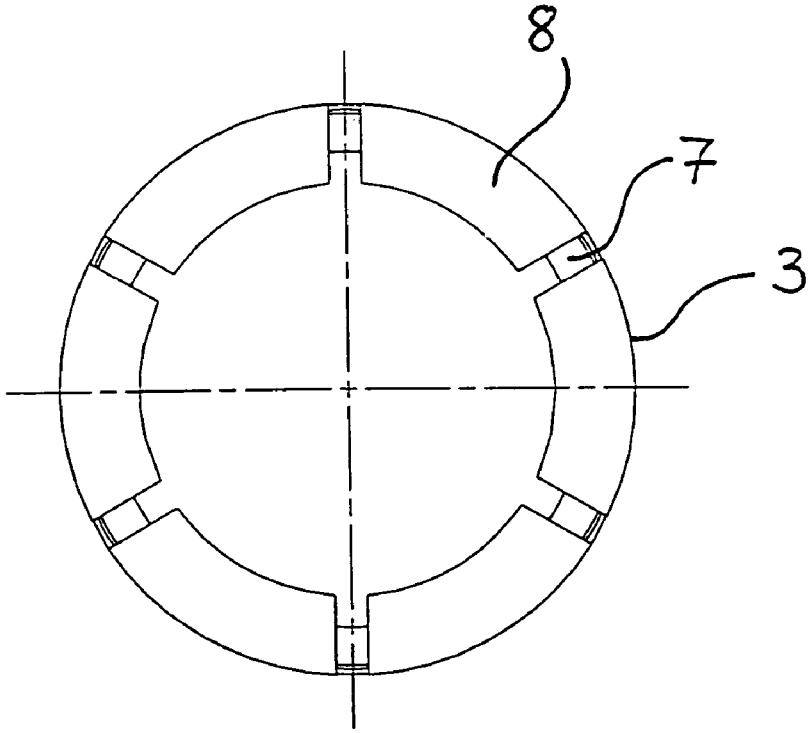
FIG. 4 is a plan view of the contact device according to FIG. 3.

FIG. 4 shows the contact part 3 according to FIG. 3 in a plan view.

Figure 5:
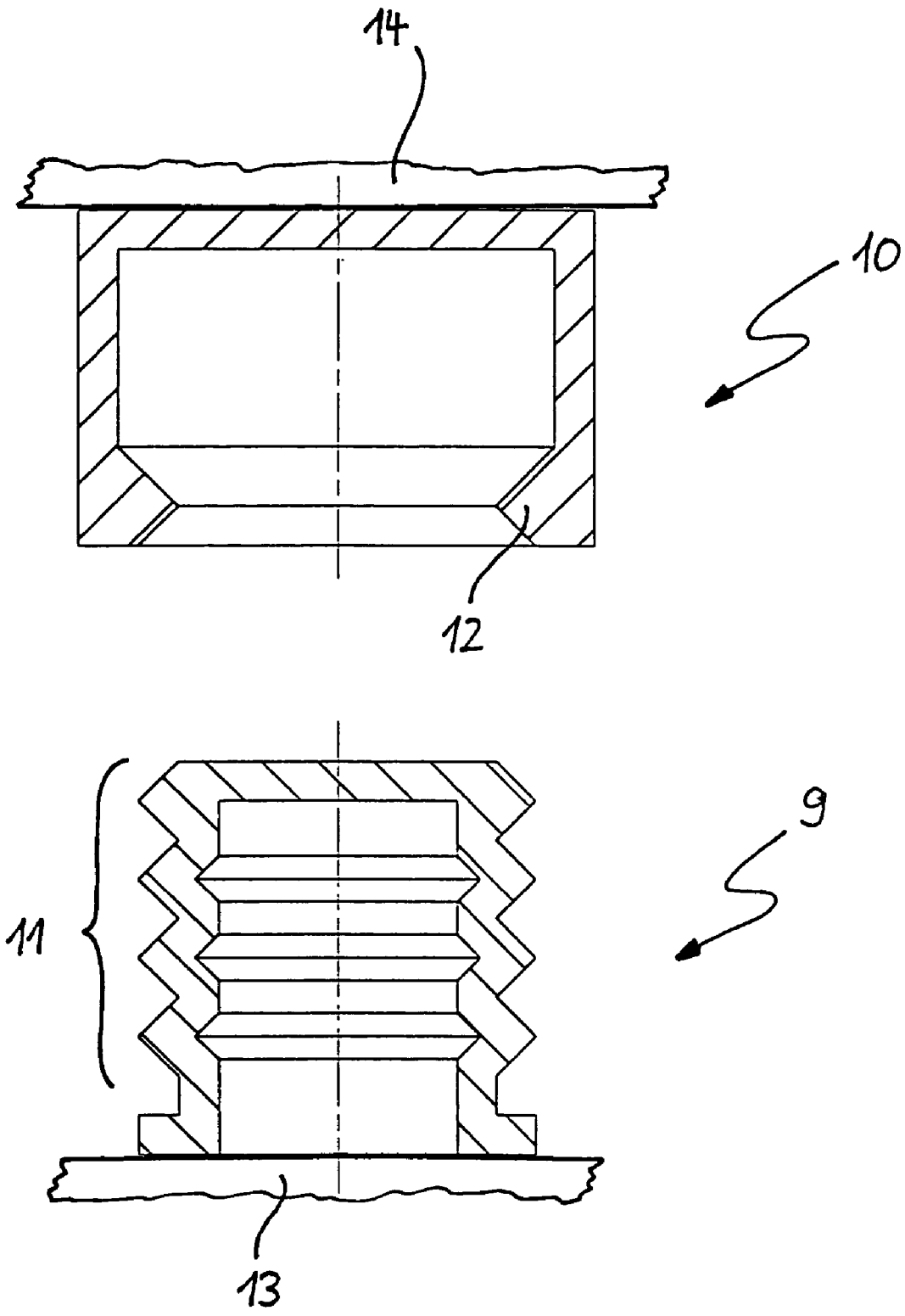
FIGS. 5 to 7 are sectional views of a third embodiment for two contact partners before contacting and in two different assembled configurations.
Figure 6:
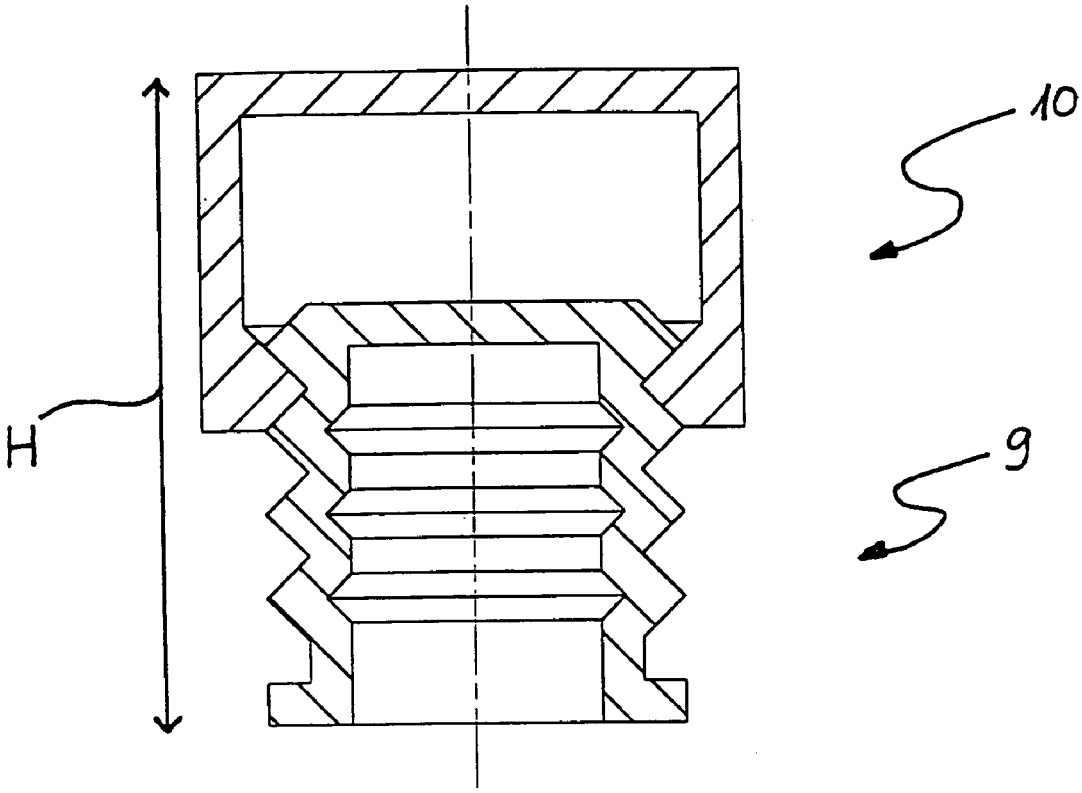
Figure 7:
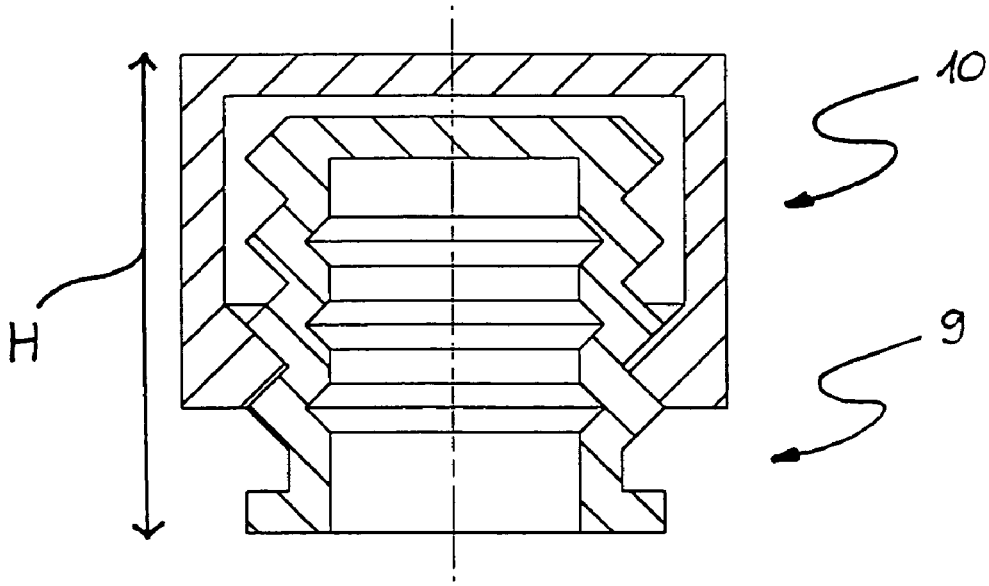

In FIGS. 5 to 7, a third embodiment of two contact partners has been shown prior to assembly of the contact partners and in two different assembled positions. FIG. 5 shows the two contact partners before contacting and thus a contact arrangement comprised of a first contact part 9 and a second contact part 10. These two contact parts 9 and 10 can be either the complete contact partners or can have other elements, accessories or the like. The first contact part 9 has longitudinally therealong a sawtooth contact region while the second contact part has at least one triangular projection 12 extending at least partly around its periphery but preferably radially completely around its periphery and which in its outer contour, corresponds to that between saw teeth of the sawtooth contact region 11 of the first contact part 9. The saw teeth of the contact region 11 in an especially advantageous means also extend completely around the periphery of the member 9 and project radially therefrom. They can, however, also extend segmentally around the member 9. The two contact parts 9 and 10 are connected with their associated contact surfaces 13, 14 (for example by abutment) or by bonding (for example by soldering or the like).

The second contact part 10 is connected with the contact surface 14 for example by an adhesive bonding with an electrically conductive adhesive, the contact surface 14 forming a component of an antenna structure which, for example, can be found on a window pane of a vehicle.

In FIGS. 6 and 7, the two contact parts 9 and 10 have been shown in two different assembled positions in the contact forming state. In FIG. 6, the triangular projection 12 has been illustrated in the upper most trough of the saw tooth shaped contact region 11 of the contact part 9. In this case, there is a certain distance between the two contact surfaces 13 and 14 which have not been identified in FIG. 6 so that the spacing between them can be the height "H" which has been shown in FIG. 6. By contrast thereto, in FIG. 7 the triangular projection 12 is in a lower trough of the saw tooth contact region 11 so that a significantly reduced height "H" is provided between the two contact surfaces 13, 14 by comparison with the height "H" illustrated in FIG. 6. This demonstrates how height differences are compensated in an especially advantageous manner.

In addition, with this configuration of the two contact parts 9, 10, contact is not only made with the electronic device, but the latter is also fastened. The contact parts 9, 10 as has been illustrated in FIGS. 5 to 7 can have in an especially advantageous way, a round cross section. They may have, however, also an elongated cross section, above all with round edge regions so that not only can the connector compensate for height differences but it can also compensate for longitudinal differences. In addition, it is not absolutely required that the triangular shaped projection lie completely in a corresponding region of the sawtooth contact region 11. In this case, it is at least partly conceivable to provide a spacing or distance. In an expressly advantageous manner, however, the triangular projection 12 can lie under a certain prestress against the sawtooth contact region 11 to insure permanent contacting as well as a fixed position attachment without play.

In addition to the illustrated and described sawtooth or triangular shaped configurations, other geometric shapes (like, for example, a corrugated shape) are conceivable. Nevertheless, the sawtooth shape of the contact region 11 and the associated triangular shape of the projection 12 afford the advantage that both the contacting and the fixing in position are optimal and enable dismounting of the electronic unit.

Figure 8:
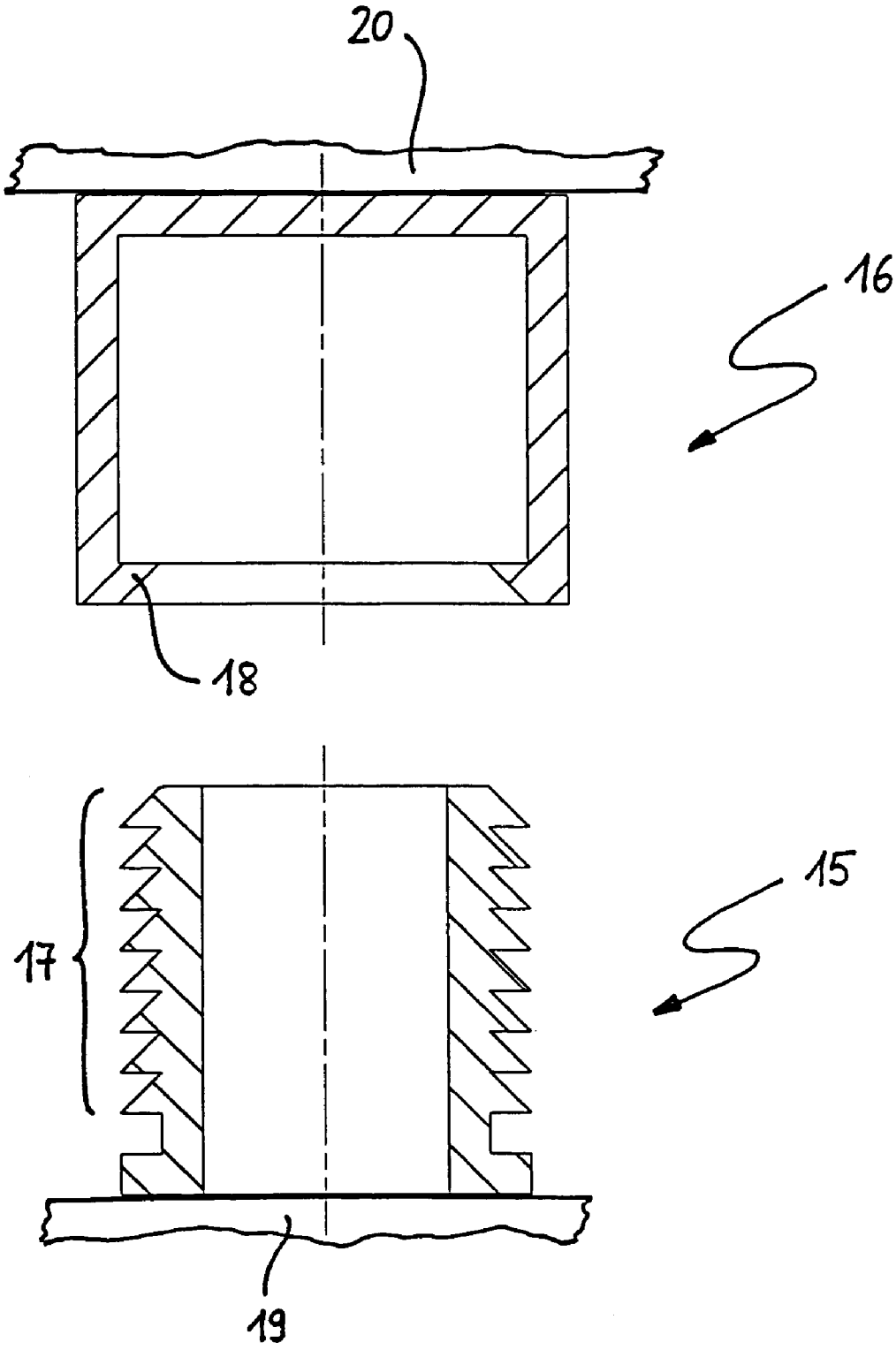
FIGS. 8 to 10 are cross sectional views of a fourth embodiment of two contact partners before contacting and in two different assembled configurations.
Figure 9:
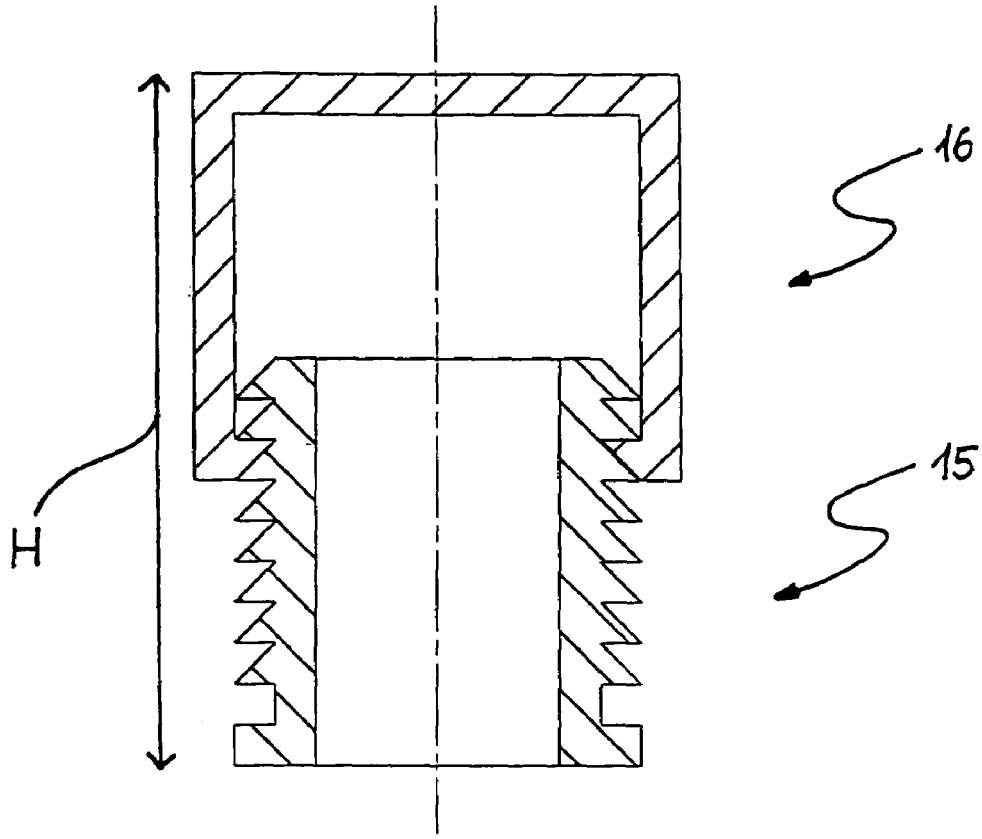
Figure 10:
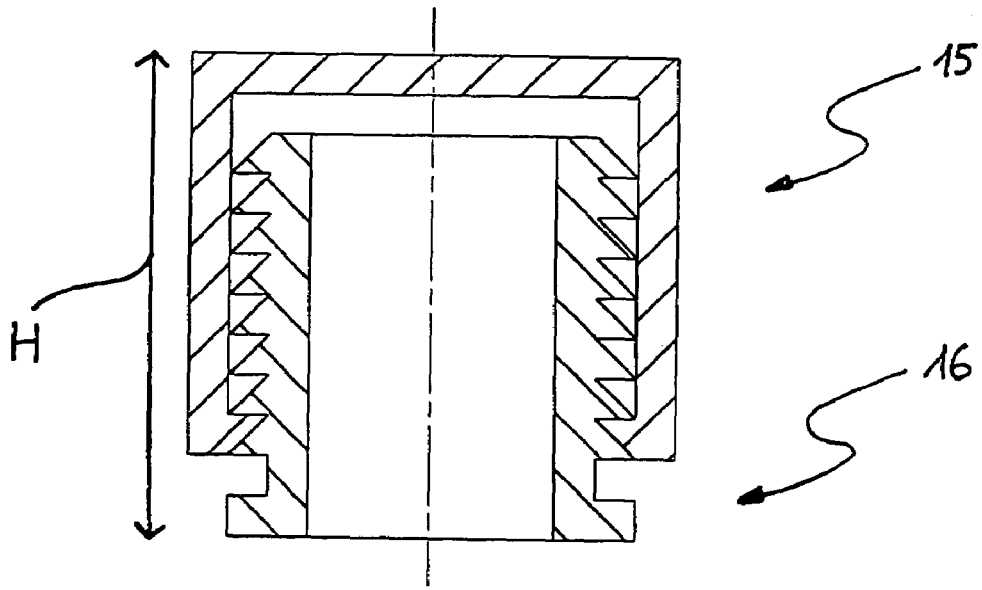

In FIGS. 8 to 10, a fourth embodiment of the two contact partners prior to contacting and in two different assembled positions have been illustrated. By analogy to FIG. 5, FIG. 8 shows that a first contact part 15 and a second contact part 16 can be provided. The first contact part 15 has a sawtooth contact region 17 as in the embodiment of FIG. 5 while the second contact part 16 has a corresponding triangular projection 18. The two contact parts 15 and 16 as in the case of FIG. 5, are connected to or connectable with contact surfaces 19 and 20.

FIGS. 9 and 10 make clear that by means of the two contact parts 15 and 16, contacting and positional fixing between the two contact surfaces 19, 20 (not shown in FIGS. 9 and 10) is possible so that here as well, different heights "H" can be bridged. Because of the sawtooth region in the embodiment shown in FIGS. 8 to 10 and the associated projection 18, contact assembly in only one direction is possible and disassembly is limited or prevented in the opposite direction. These contact parts 15 and 16 also have advantageous circularly round cross sections although other cross sections, like especially a rectangular cross section and one with an open peripheral region are also conceivable. If, for example, a plurality contact parts 15 with rectangular or square cross sections are disposed flush with one another and are brought into contact with corresponding contact parts 16, a disassembly with the illustrated configuration of the sawtooth is possible in that the shifting of the parts along the contact parts 16 which are also arranged flush with one another in the direction in which they are arranged flush is possible.

Finally, mention should be made of the fact that while in the figures four concrete assembles have been illustrated, other embodiments and configurations according to the invention are conceivable.

The invention claimed is:

1. An antenna assembly for a motor vehicle comprising:

an antenna amplifier having a printed circuit board with at least one electrical conductor and mounted on a body of an automotive vehicle;

an antenna on a window of said vehicle having at least another electrical conductor; and a device for making electrical contact between said conductors and for simultaneously securing said antenna amplifier to the body of the automotive vehicle, said device comprising:

a first contact partner having a contact face secured to and electrically connected with said one electrical conductor, and a second contact partner having a contact face secured to and electrically connected with said other electrical conductor, one of said contact partners having an electrically conductive surface at least partly form-fittingly surrounding and releasably embracing a corresponding electrically conductive surface of the other contact partner, one of said contact partners having a row of teeth and the other contact partner having a tooth engageable in said row for securing said contact partners together with a selected spacing between said faces.

2. The antenna assembly defined in claim 1 wherein at least one of said contact faces is soldered to the respective electrical conductor.

3. The antenna assembly defined in claim 1 wherein at least one of said contact faces is bonded to the respective electrical conductor with a conductive adhesive.

4. The antenna assembly defined in claim 1 wherein both of said contact partners are cup shaped and fit one into the other.

5. An antenna assembly for a motor vehicle comprising:

an antenna amplifier having a printed circuit board with at least one electrical conductor and mounted on a body of an automotive vehicle;

an antenna on a window of said vehicle having at least another electrical conductor; and a device for making electrical contact between said conductors and for simultaneously securing said antenna amplifier to the body of the automotive vehicle, said device comprising:

a first contact partner having a contact face secured to and electrically connected with said one electrical conductor, and a second contact partner having a contact face secured to and electrically connected with said other electrical conductor, one of said contact partners having an electrically conductive surface at least partly form-fittingly surrounding and releasably embracing a corresponding electrically conductive surface of the other contact partner, one of said contact partners being generally cup shaped and formed with a mouth receiving the other contact partner and provided with a plurality of slits running to said mouth.

6. The antenna assembly defined in claim 5 wherein a collar is provided around said mouth and a pressure ring is provided in said collar.

7. The antenna assembly defined in claim 5 wherein at least one of said contact faces is soldered to the respective electrical conductor.

8. The antenna assembly defined in claim 5 wherein at least one of said contact faces is bonded to the respective electrical conductor with a conductive adhesive.

* * * * *